US011278084B2

(12) United States Patent
Spinelli

(10) Patent No.: US 11,278,084 B2
(45) Date of Patent: Mar. 22, 2022

(54) LACE LOCK AND LACING SYSTEM FOR SHOES

(71) Applicant: 10 OTTOBRE S.R.L., Certaldo (IT)

(72) Inventor: Andrea Spinelli, Arezzo (IT)

(73) Assignee: 10 OTTOBRE S.R.L., Certaldo (IT)

( * ) Notice: Subject to any disclaimer, the term of this patent is extended or adjusted under 35 U.S.C. 154(b) by 0 days.

(21) Appl. No.: 16/968,597

(22) PCT Filed: Feb. 5, 2019

(86) PCT No.: PCT/IT2019/050027

§ 371 (c)(1),
(2) Date: Aug. 9, 2020

(87) PCT Pub. No.: WO2019/155503

PCT Pub. Date: Aug. 15, 2019

(65) Prior Publication Data

US 2021/0235817 A1 Aug. 5, 2021

(30) Foreign Application Priority Data

Feb. 8, 2018 (IT) ..... 102018000002507

(51) Int. Cl.

| | |
|---|---|
| ***A43C 1/06*** | (2006.01) |
| ***A43B 1/00*** | (2006.01) |
| ***A43C 9/06*** | (2006.01) |

(52) U.S. Cl.

CPC ..... *A43C 1/06* (2013.01); *A43B 1/0054* (2013.01); *A43C 9/06* (2013.01)

(58) Field of Classification Search

CPC ..... A43C 1/06; A43C 9/06; A43B 1/0054
See application file for complete search history.

(56) References Cited

U.S. PATENT DOCUMENTS

| | | | | |
|---|---|---|---|---|
| 1,489,117 | A * | 4/1924 | Jean | A43C 7/00 24/712.6 |
| 3,225,402 | A * | 12/1965 | Altman | A43C 7/04 24/712.6 |
| 5,097,573 | A * | 3/1992 | Gimeno | A43C 7/00 24/712.2 |
| 9,185,948 | B2 * | 11/2015 | Ben-Arie | A43C 7/04 |
| 9,808,050 | B2 * | 11/2017 | Ben-Arie | A43C 7/04 |
| 10,390,590 | B2 * | 8/2019 | Ben-Arie | A44B 11/125 |
| 2004/0187757 | A1 * | 9/2004 | Siewert | B63B 21/08 114/218 |
| 2011/0067211 | A1 * | 3/2011 | Huber | A43B 5/0401 24/712.1 |
| 2013/0160256 | A1 * | 6/2013 | Waldman | A43C 7/04 24/712.6 |
| 2016/0270481 | A1 * | 9/2016 | Harden | A43B 1/0054 |

* cited by examiner

*Primary Examiner* — David M Upchurch
(74) *Attorney, Agent, or Firm* — Mark M. Friedman

(57) ABSTRACT

Lace lock comprising a body with openings crossed by a lace (4) and with means for locking and unlocking the lace. Said body is constituted by a frame (1) on which two opposed levers (2*d*, 2*s*) are hinged, with a right lever (2*d*) and a left lever (2*s*), each of which can rotate on said frame (1) to assume a raised position (A) and respectively a lowered position (B), in which in the raised position (A) each lever (2*d*, 2*s*) leaves a corresponding space (3*d*, 3*s*), crossable by a lace (4), space that is closed when the levers (2*d*, 2*s*) are in lowered position, so that, when the levers (2*d*, 2*s*) are raised, the lace (4) is free to slide between each of the levers (2*d*, 2*s*) and the frame (1) and vice versa, when the levers (2*d*, 2*s*) are lowered, the lace (4) is locked.

15 Claims, 12 Drawing Sheets

LACE LOCK AND LACING SYSTEM FOR SHOES

This invention concerns a shoe lace lock and a shoe lacing system.

More specifically, a shoe lace lock in accordance with this invention allows to lock the strings without the need to make knots or bows, thus being particularly suitable for use by children, the elderly, people with reduced mobility and, more generally, suitable for use on any footwear with string lacing system. In addition, a lace lock in accordance with the invention is of simple manufacture and particularly economical in relation to the advantages offered. In addition, a special string can be associated with the lace lock in question to create a particularly effective lacing system for footwear. US 2016/0025119 A1 describes a spring-locking lace lock in which two parts of a string are passed through channels formed in a frame on which two levers are hinged between which a spring is positioned.

A lace lock in accordance with this invention has the characteristics indicated in claim 1. Other characteristics of the invention are described in the dependent claims.

Further advantages and characteristics of the present invention will be more and better understood by every technician of the branch thanks to the description that follows and to the annexed drawings, supplied as an example but not to be considered in a limitative sense, in which.

Reduced to its essential structure and with reference to the figures in the attached drawings, a lace lock (L) in accordance with this invention consists of a frame (1) with an open central part (10). On the frame (1) are hinged two opposite levers (2*d*, 2*s*), with a right lever (2*d*) and a left lever (2*s*), each of which can rotate with respect to said frame (1) to assume a raised position (A) and, respectively, a lowered position (B). In the raised position (A) the string (4) is free to slide, while it is locked when the levers (2*d*, 2*s*) are in the lowered position. In other words, when the levers (2*d*, 2*s*) are raised, the string (4) is free to slide between each of the levers (2*d*, 2*s*) and the frame (1). Vice versa, when the levers (2*d*, 2*s*) are lowered, the string (4) is blocked, i.e. it is not free to slide.

Figure 13:
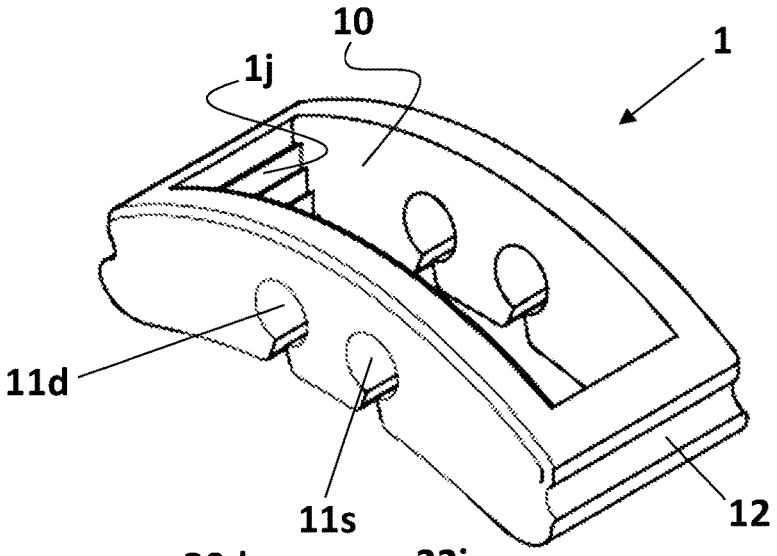
FIGS. 13 and 14 show two elements of a lace lock in conformity with the present invention.
Figure 14:
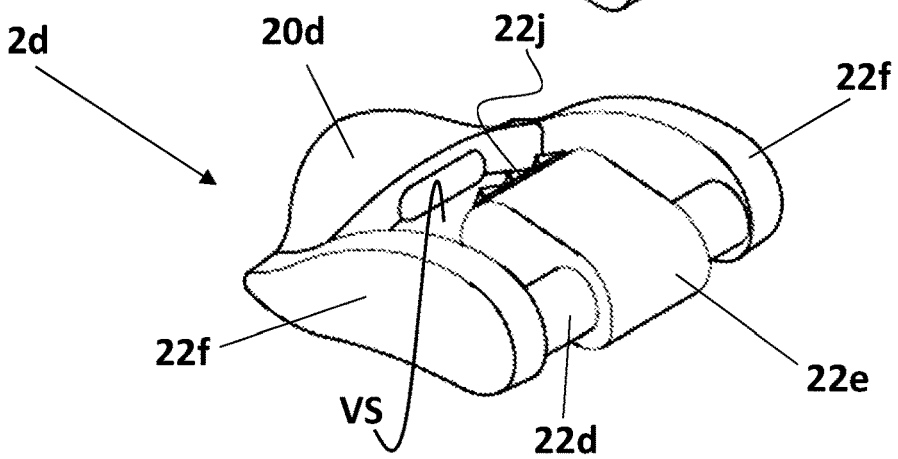

In conformity with the example shown in FIG. 13, the frame (1) has the central part (10) completely free and open both above and below, and has two seats (11d, 11s) in correspondence of its lower face, suitable to accommodate relative hinge pins presented by each of the said levers (2*d*, 2*s*). In FIG. 14, where for simplicity is represented only the lever (2*d*), the reference (22*d*) indicates the pin of the lever (2*d*) intended to be positioned in the seat (11*d*) of the frame (1). Said pin (22*d*) protrudes bilaterally from a central body (22*e*) and is developed transversely between two arms (22*f*) which, when the lever is applied to the frame (1), are external to the latter. The central body (22*e*) instead is inside the frame (1) when the lever is applied to the latter. The other lever (2*s*) has the same structure. To facilitate the lifting of the levers (2*d*, 2*s*) by the user, the same levers can be shaped in such a way as to present a free end (20*d*, 20*s*), opposite the end hinged on the frame (1), protruding beyond the respective edge (12) of the frame (1). Preferably, said free ends (20*d*, 20*s*) of the levers (2*d*, 2*s*) are concave, with the concavity pointing downwards, i.e. facing the upper (5) of the shoe on which the lace lock is used.

Figure 15:
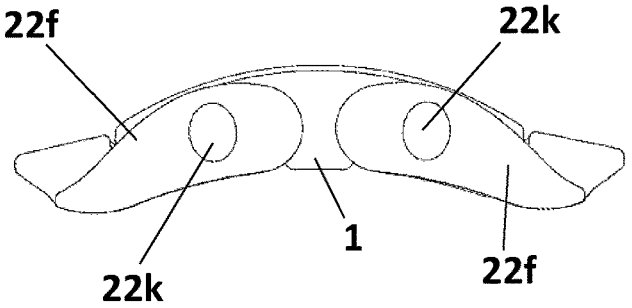
FIGS. 15-16 show a further embodiment of a lace lock in conformity with the present invention.
Figure 16:
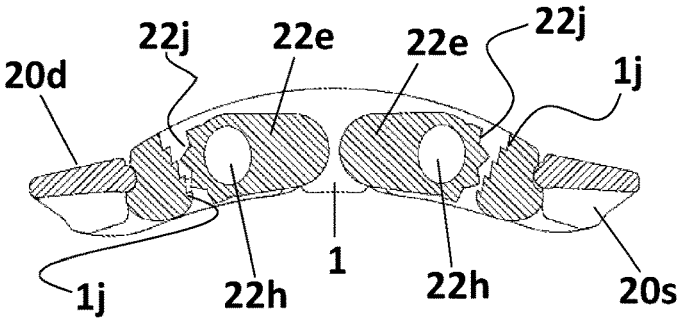

To make the aforesaid central body (22*e*) more elastic, it can be drilled, as exemplifically illustrated in FIG. 16 where the holes of each central body (22*e*) are marked by the reference "22*h*". In the example, the holes (22*h*) are oriented transversely to each central body (22*e*) as represented in the drawings. Such holes (22*h*) reduce the mass, determining a lesser stiffness of the bodies (22*e*), that is a greater elasticity of the same ones. This is particularly useful when very thick strings are used. For example, the said holes (22*h*) are obtained. during the lever (2*d*, 2*s*) moulding phase and in this phase there are corresponding holes (22*k*) also in the lateral arms (22*f*) as schematically illustrated in FIG. 15.

In FIG. 16 are particularly visible the opposite teeth (22*j*, 1*j*) formed on the central bodies (22*e*) of the levers (2*d*, 2*s*) and respectively on the internal sides of the frame (1) that face said central bodies. Said teeth (22*j*, 1*j*) are however visible also on the lace lock represented in the other figures of the annexed drawings. The presence of the teeth (22*j*, 1*j*) further favours the grip and the blocking of the string between the levers (2*d*, 2*s*) and the frame (1).

Figure 5:
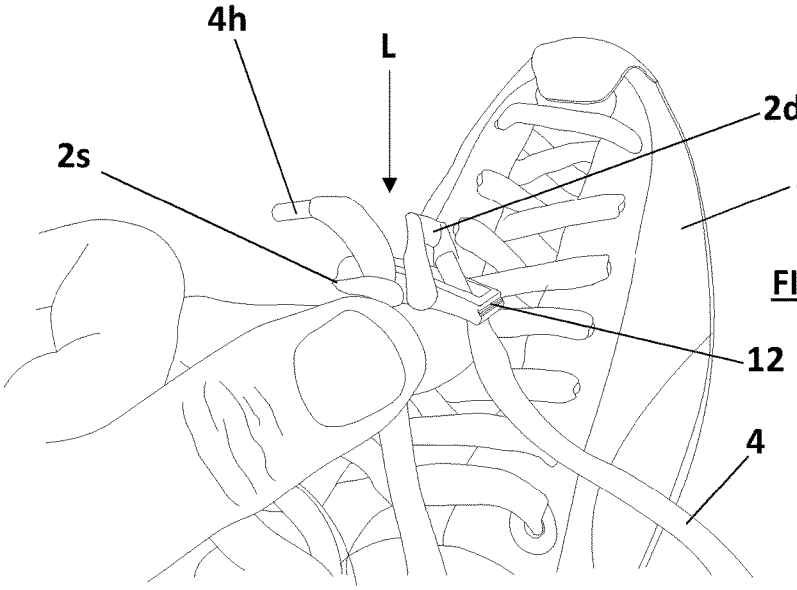
FIGS. 5-9 show the lace lock of the previous figures in different phases of use.
Figure 6:
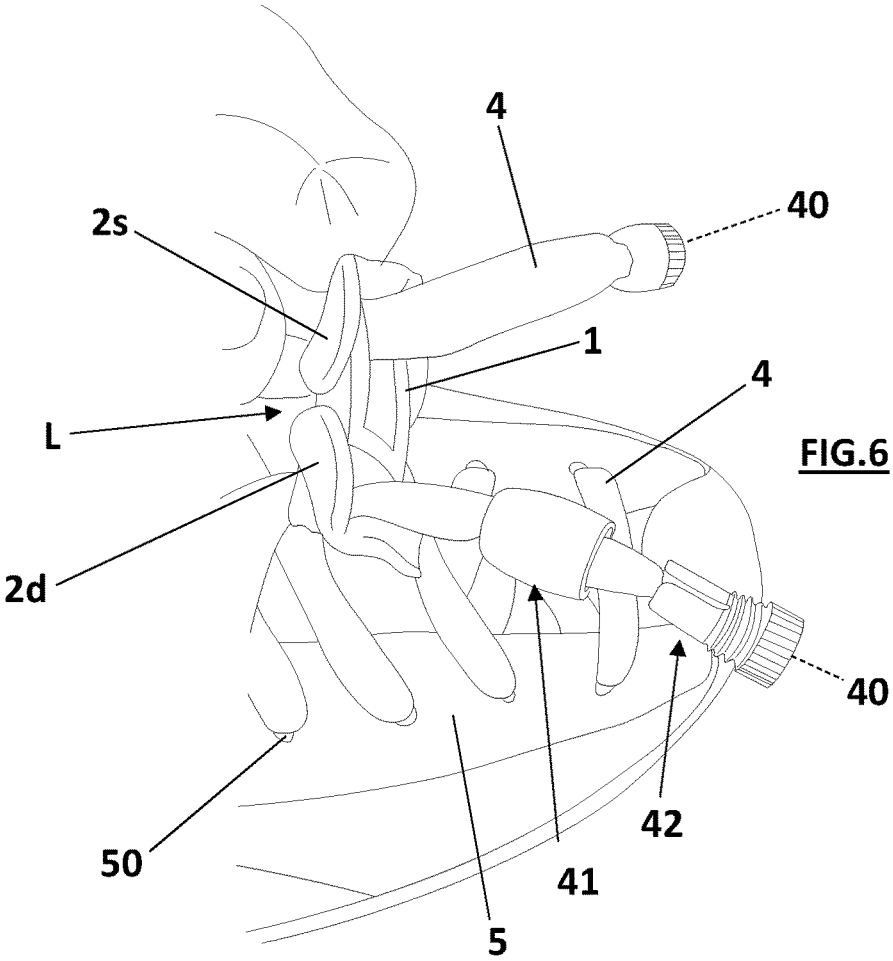
Figure 7:
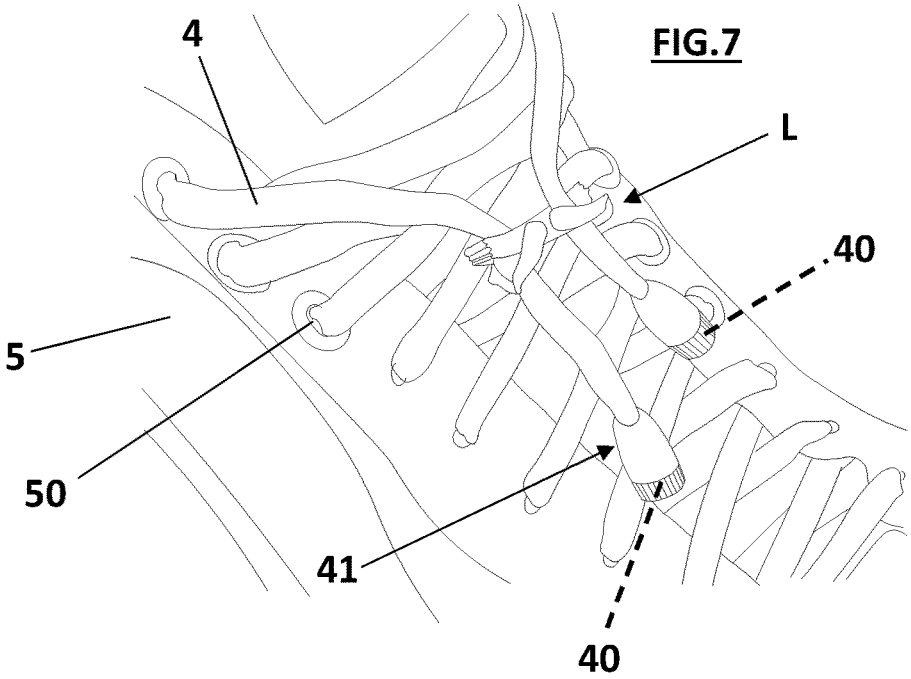
Figure 8:
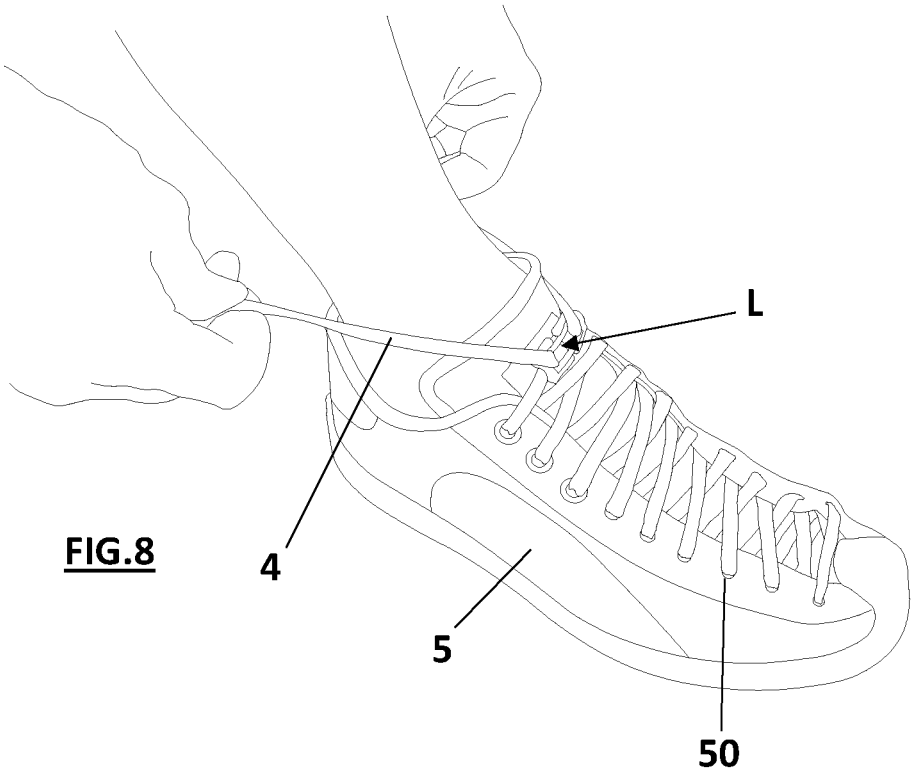

The string (4) is passed through the eyelets or holes (50) specially provided on the upper (5). Then, each end (4h) of the string (4) is passed through the space between the toothing (1*j*) of the frame (1) and the toothing (22*j*) of a respective raised lever (2*d*, 2*s*). In this way, the lace lock is associated with the shoe by means of the string (4). These steps are schematically illustrated in FIGS. 5-7.

Figure 1:
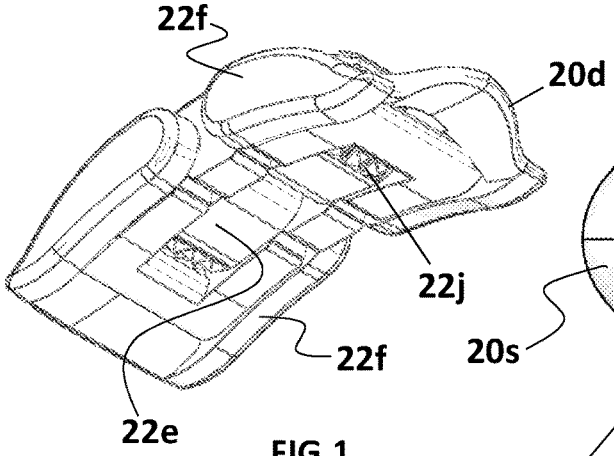
FIGS. 1-3 show a possible embodiment of a lace lock according to the present invention in a perspective view from below, in plan from above and, respectively, in lateral view, with the levers (2*d*, 2*s*) lowered.
Figure 2:
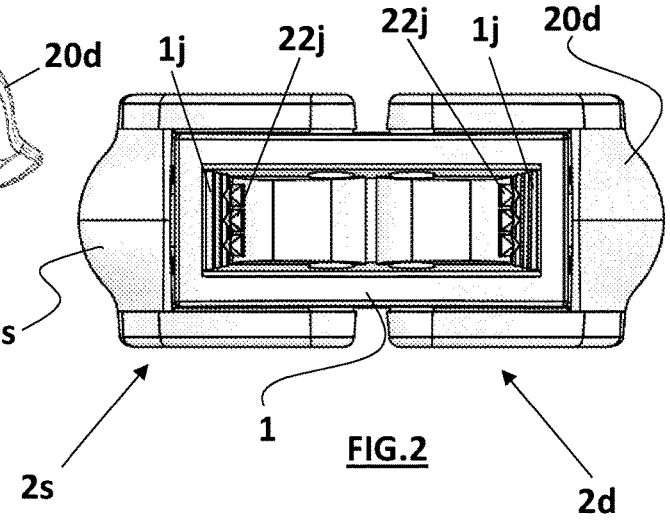
Figure 4:
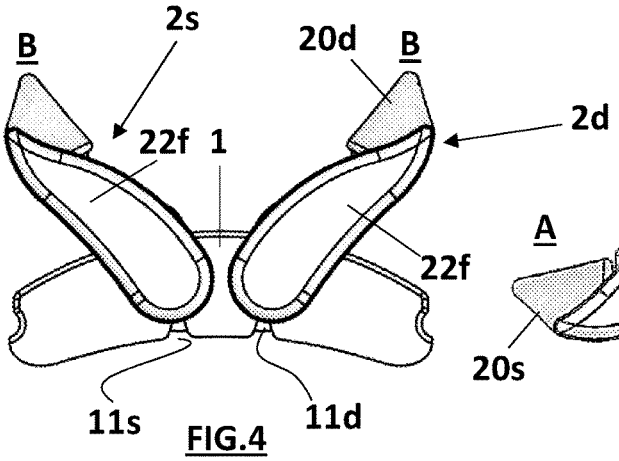
FIG. 4 shows a lateral view of the lace lock of FIGS. 1-3 with the levers (2*d*, 2*s*) in lowered position.
Figure 3:
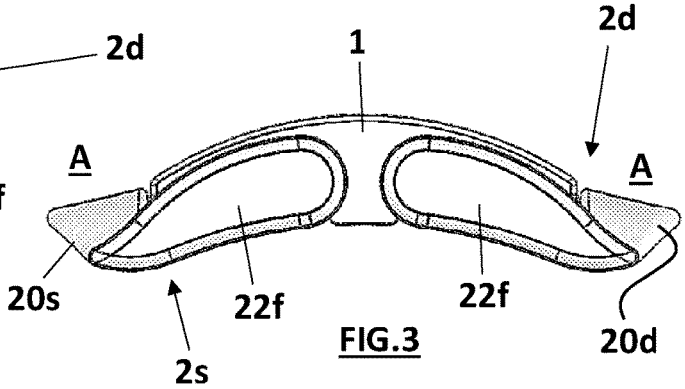

In accordance with the present invention, the levers (2*d*, 2*s*) can have a structure that allows the string to pass through them. As shown in FIG. 14, each lever (2*d*, 2*s*) has an empty space (VS) between the central body (22*e*) and the free end (20*d*, 20*s*), If the central body (22*e*) is provided with toothing (22*j*), as visible in the examples of FIG. 2, FIG. 14 and FIG. 16, the space (VS) is between the toothing (22*j*) and the free end (20*d*, 20*s*). In said empty space the string is passed. The space (VS) allows to position the levers (2*d*, 2*s*) in a lowered position adhering to the frame as exemplified in FIG. 1, FIG. 2, FIG. 3, FIG. 15 and FIG. 16, with the string (4) passing through this space.

Figure 17:
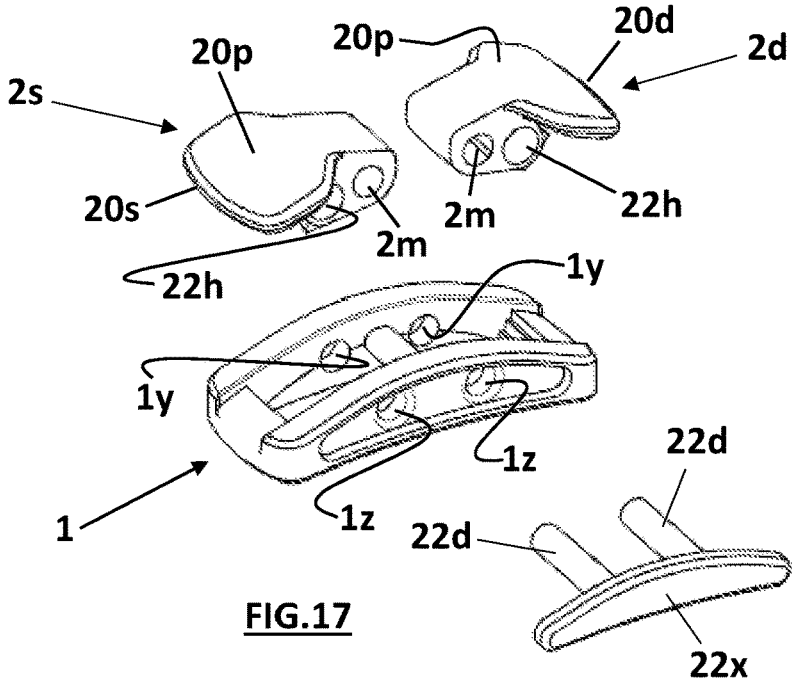
FIGS. 17-19 show another further embodiment of a lace lock in conformity with the present invention.
Figure 18:
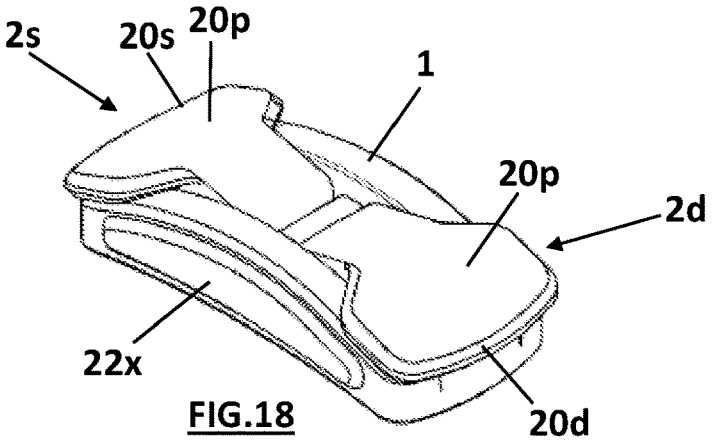
Figure 19:
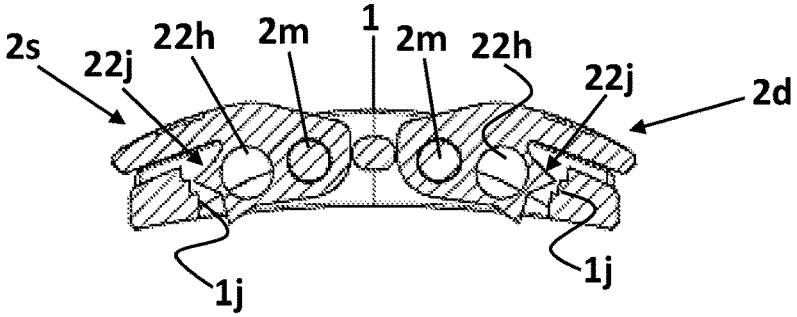
Figure 1:
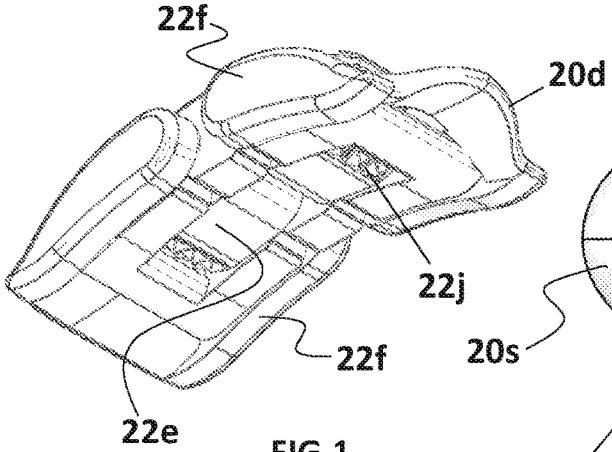
Figure 2:
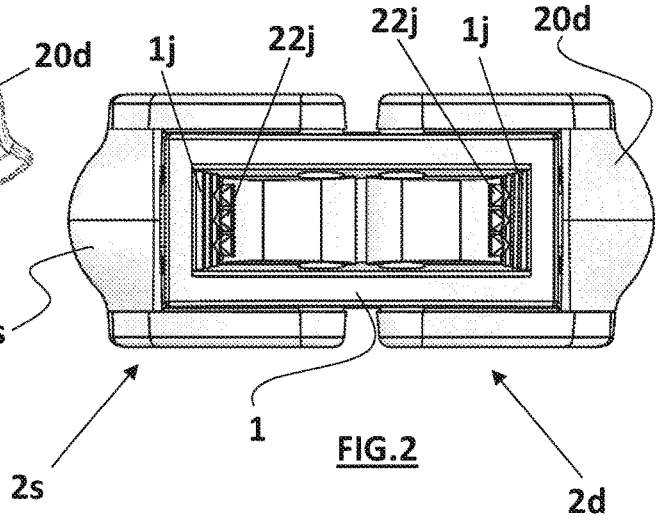
Figure 4:
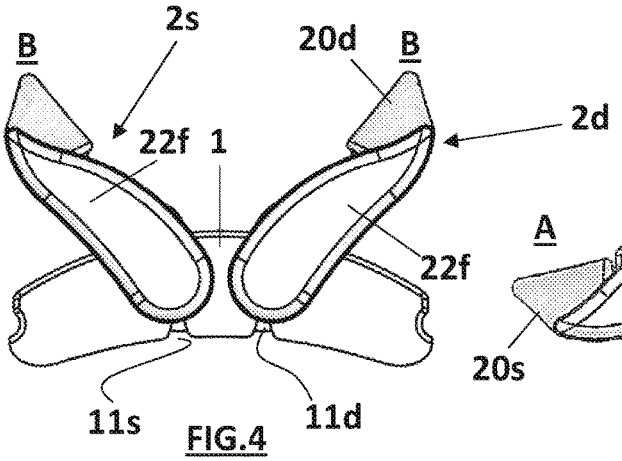
Figure 3:
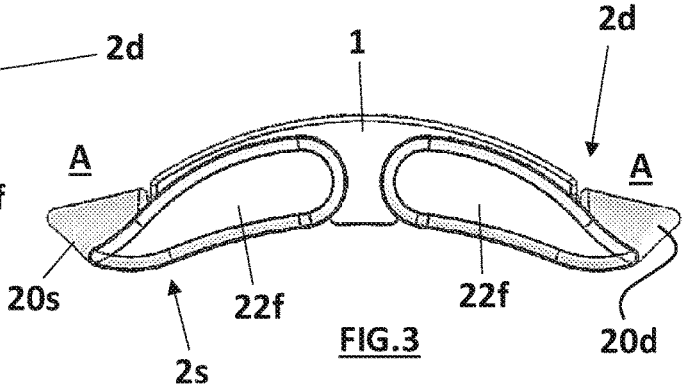
Figure 5:
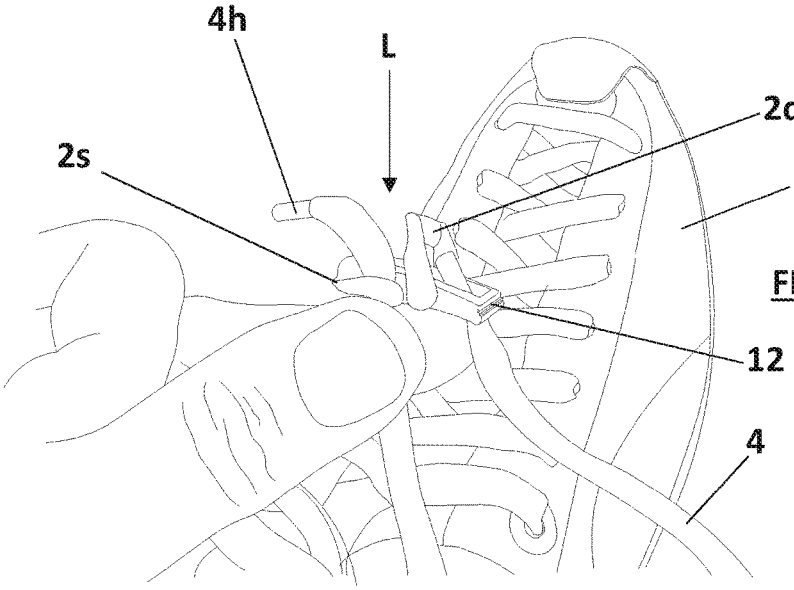
Figure 6:
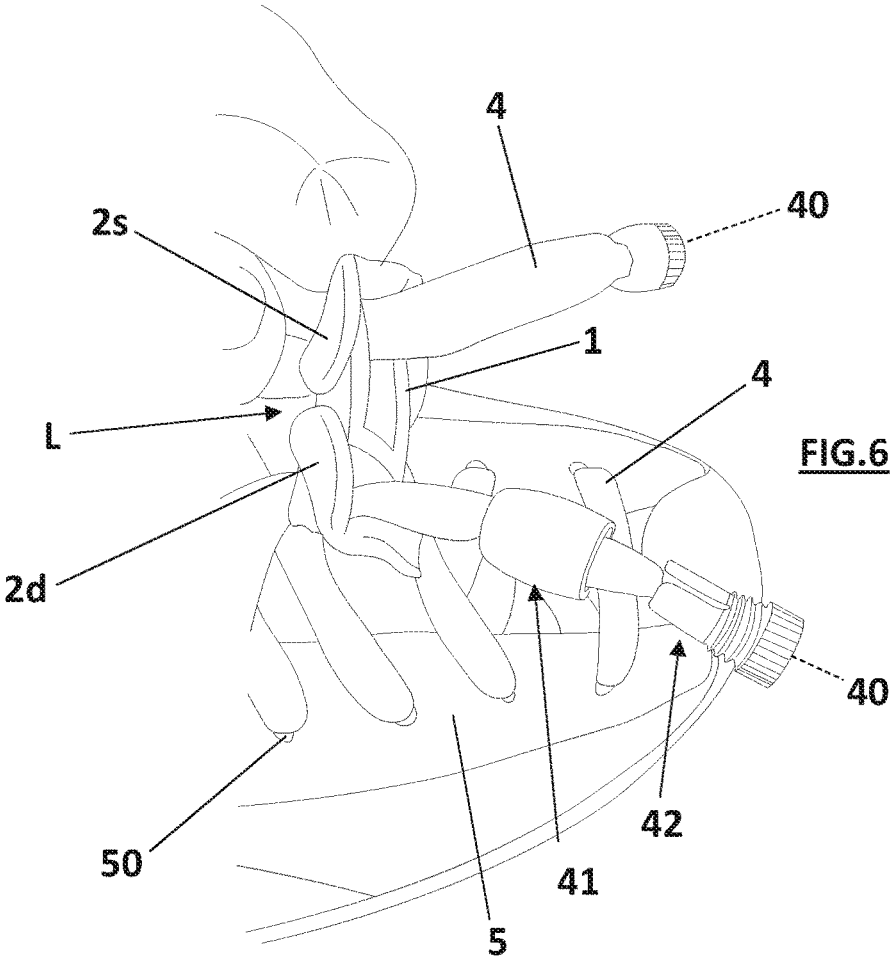
Figure 7:
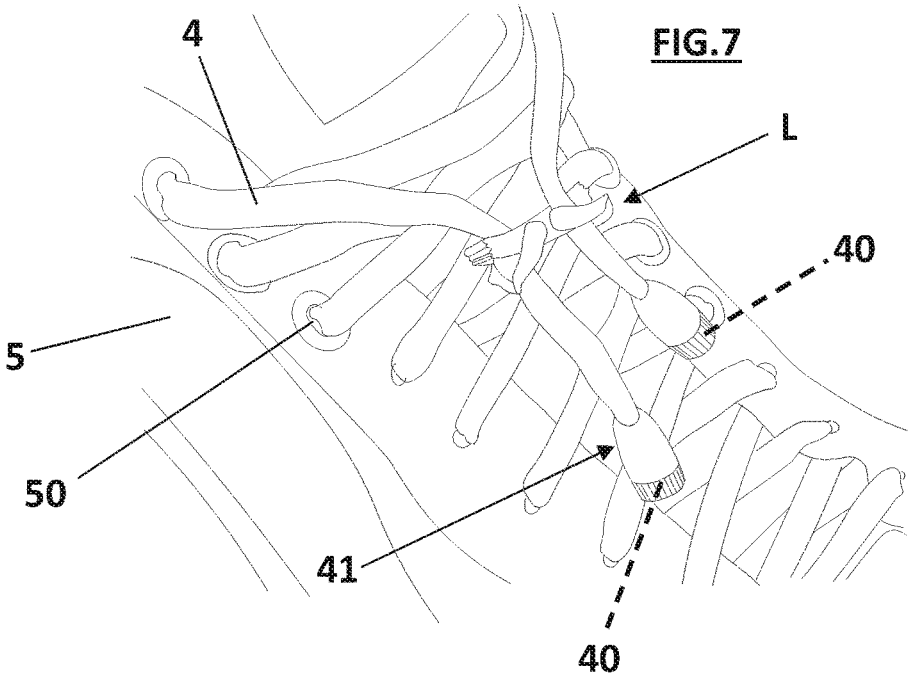
Figure 8:
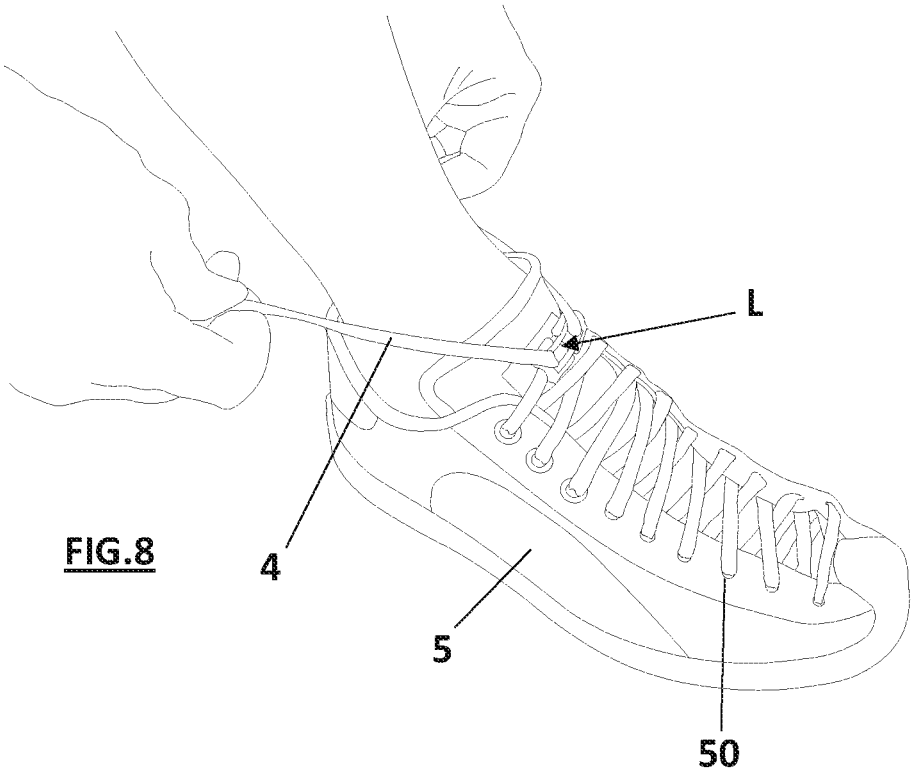
Figure 9:
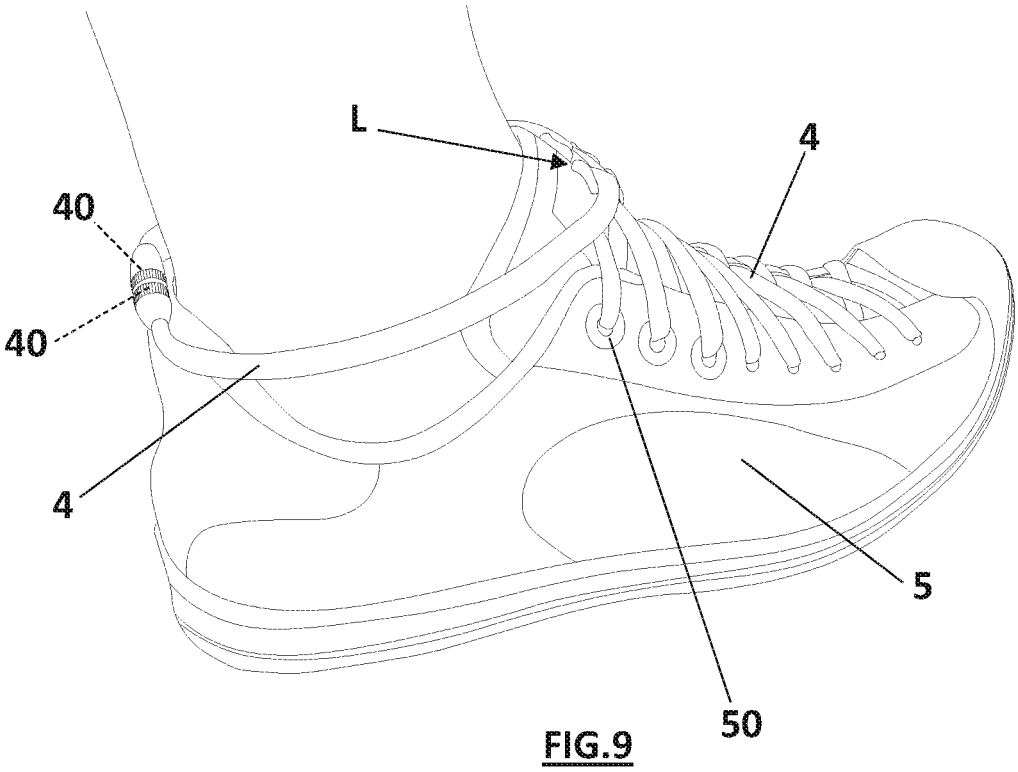
Figure 11:
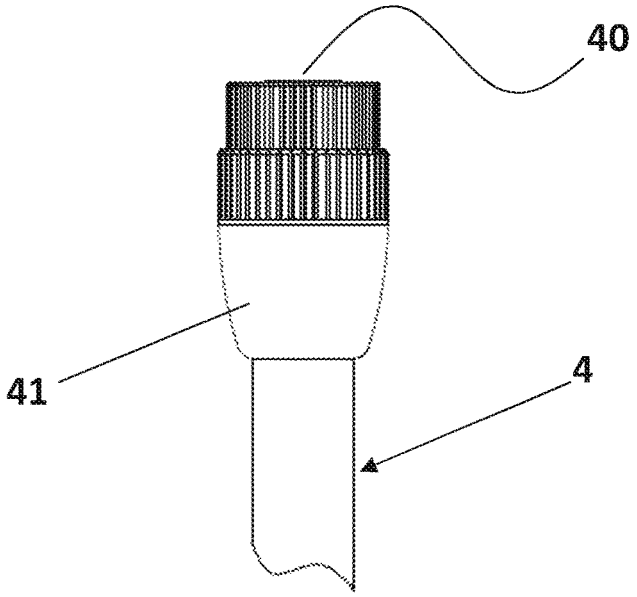
Figure 11:
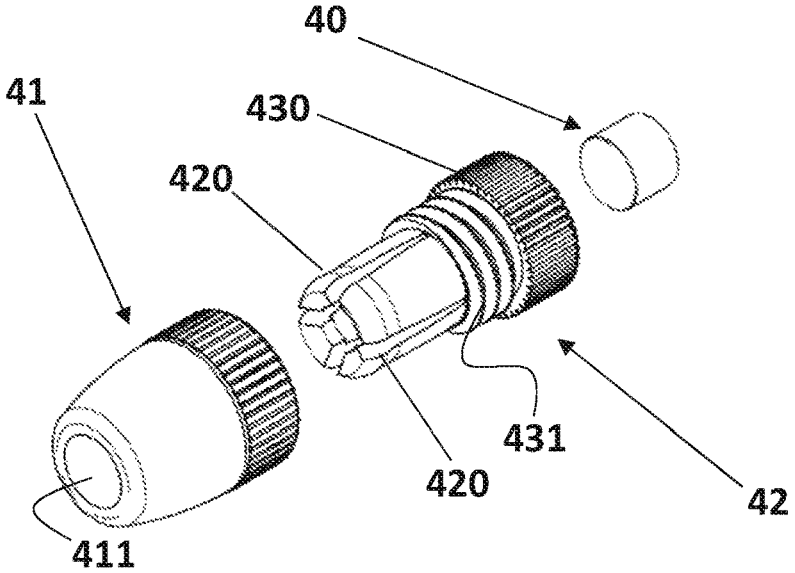
Figure 12:
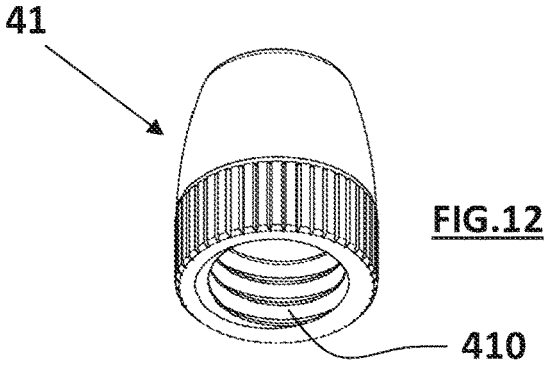
Figure 13:
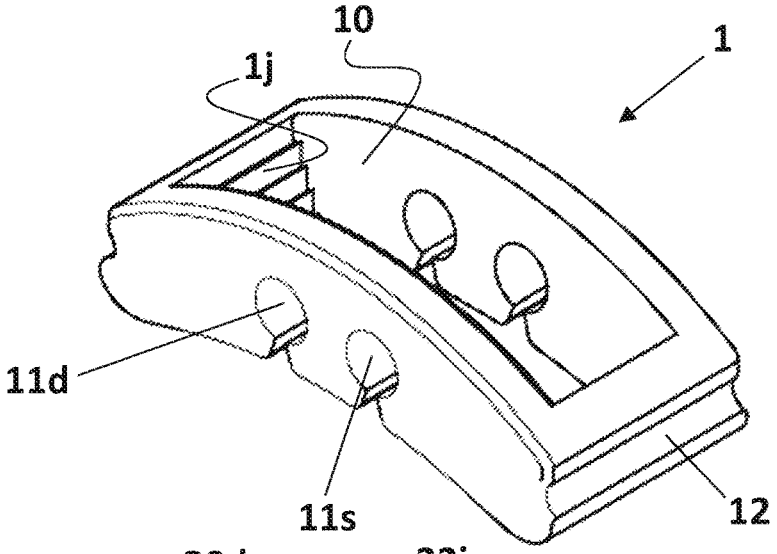
Figure 14:
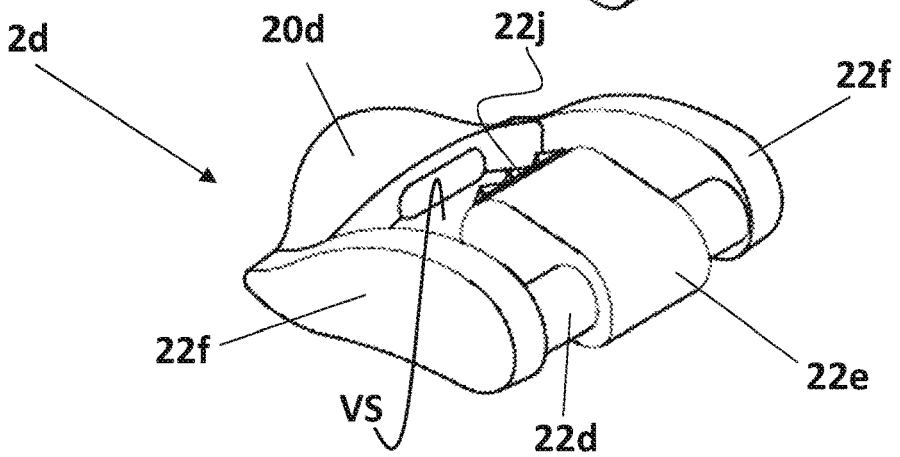
Figure 15:
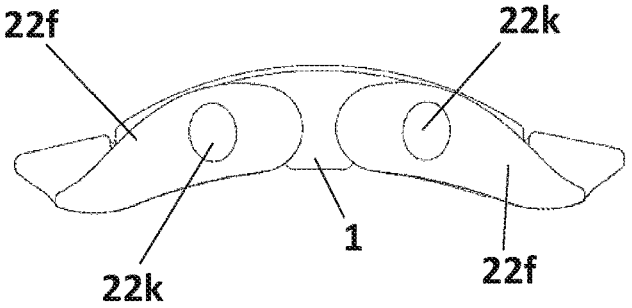
Figure 16:
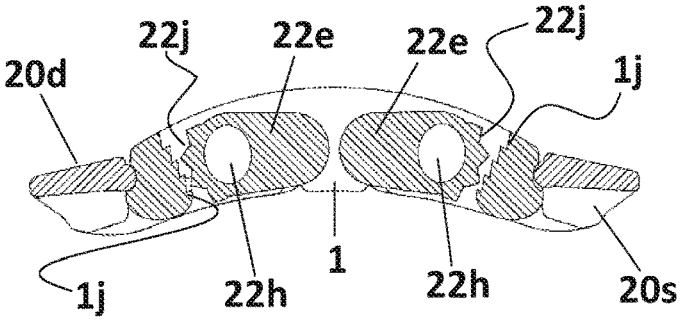
Figure 17:
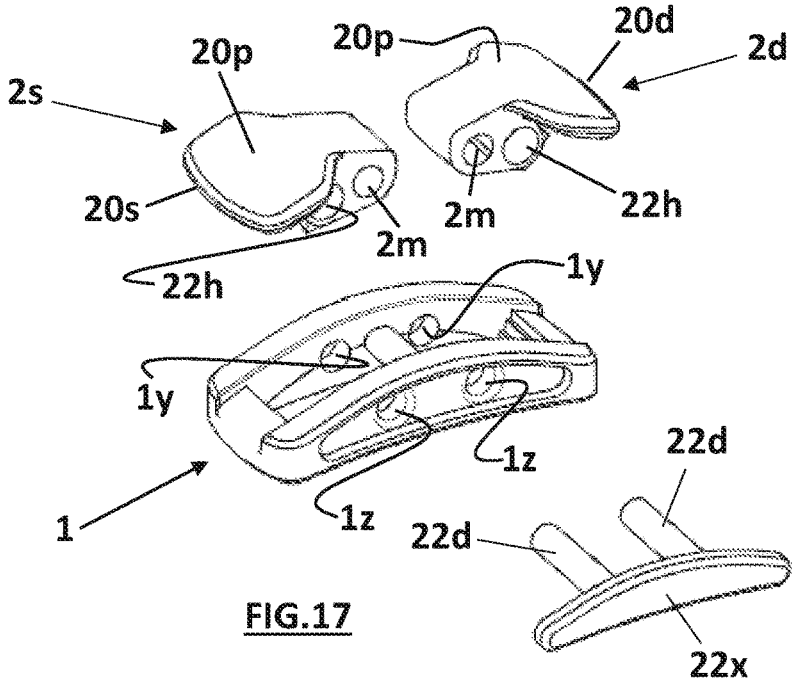
Figure 18:
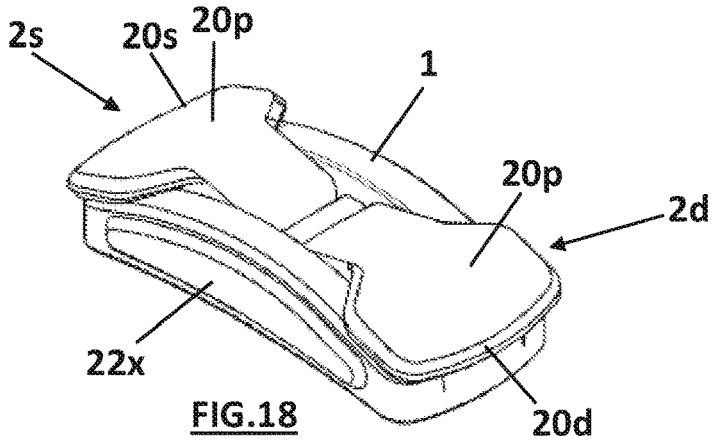
Figure 19:
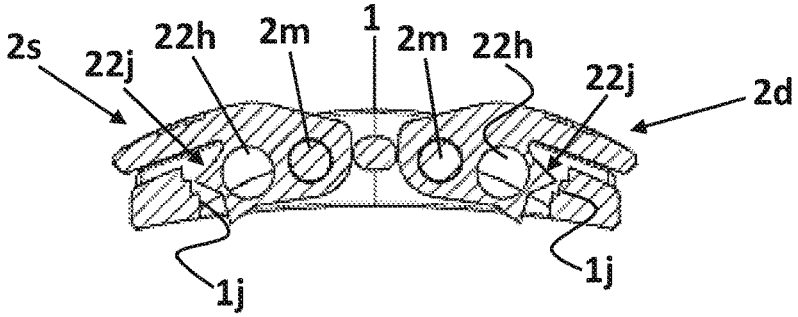

With reference to the example illustrated in FIG. 17-19, the levers (2*d*, d2) have the upper part formed by a continuous surface (20*p*) that joins the central body (22*e*) with the free front side (20*d*, 20*s*). As in the previous examples, the central body (22*e*) of each lever (2*d*, 2*s*) preferably has a toothing (22*j*) which, in the assembled configuration of the lace lock, results in front of a toothing (1*j*) presented by the frame (1) in correspondence of a respective inner side. The said teeth (1*j*, 22*j*) are not necessarily present and are not necessarily formed both on the frame (1) and on the levers (2*d*, 2*s*).

Each lever (2*d*, 2*s*) is hinged to the frame (1) by a corresponding transverse pin (22*d*). The two pins (22*d*) fit into the corresponding holes (2*m*) of the levers (2*d*, 2*s*) and are joined together by a connecting surface (22*x*) which is external to the frame (1) when the lace lock is assembled. On the side opposite to that of the surface (22*x*), the two pins (22*d*) fit into special seats (1*y*) on the side of the frame (1) opposite to that on which the surface rests (22*x*). The pins (22*d*) are also inserted into two holes (1*z*) on the side of the frame (1) opposite that of the seats (1*y*). Also in this example, the central body (22*e*) of the levers (2*d*, 2*s*) has a lightening vacuum (22*h*). This form of construction of the lace lock in accordance with the present invention simplifies, in particular, the assembly.

To block the string (4), the two left and right branches of the latter are pulled outwards, one to the right and the other to the left, so determining the sliding of the frame (1) towards the upper (5). When the desired traction is reached, the two levers (2*d*, 2*s*) are lowered and the string is blocked, without the need to make knots. After this locking, if desired, it is still possible to knot the string by making a bow.

Figure 9:
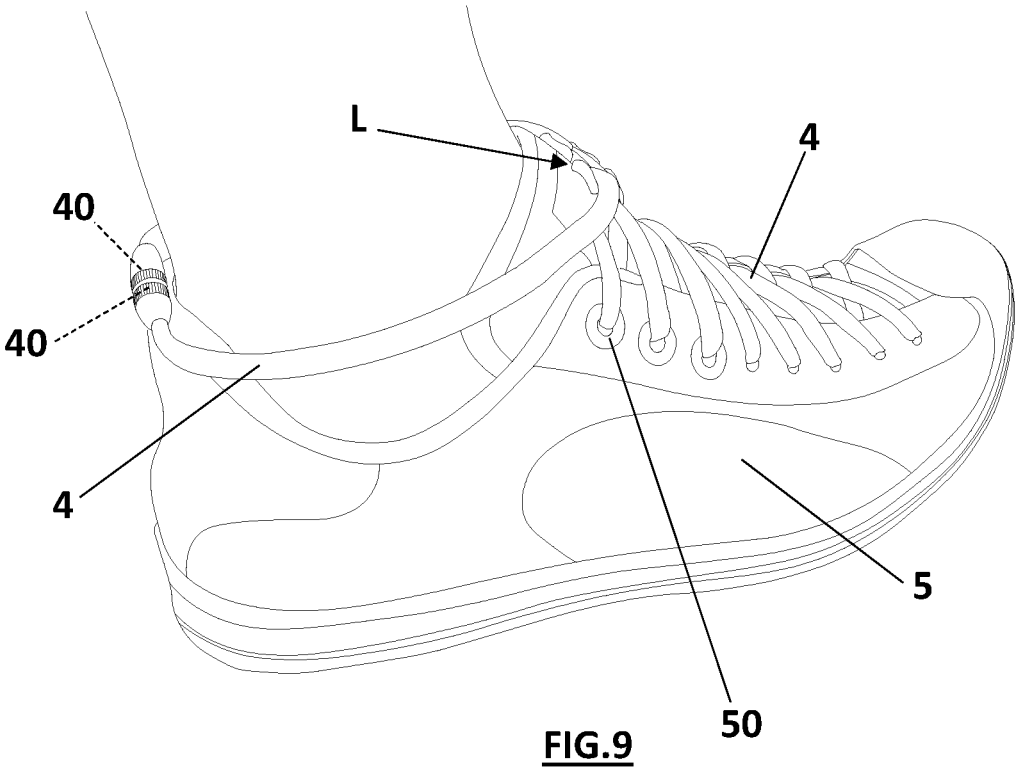

Preferably, the string (4) is equipped, at both ends, with magnets (40) with opposite poles that allow the ends of the string to be magnetically connected to each other, as illustrated in FIG. 9, so as to avoid that the portions of the string (4) protruding from the lace lock (L) can swing downwards. in the example shown in FIG. 9 the two ends of the string (4) are hooked together behind the user's ankle.

Figure 10:
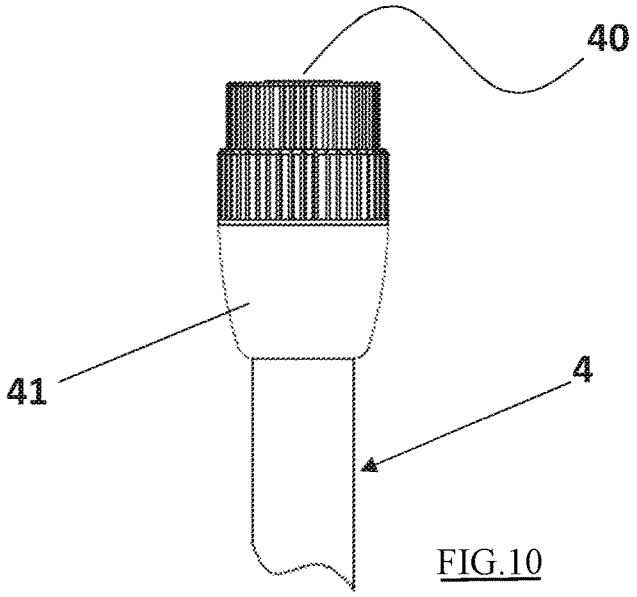
FIGS. 10 and 11 show a magnetic end cap applicable to the string.
Figure 11:
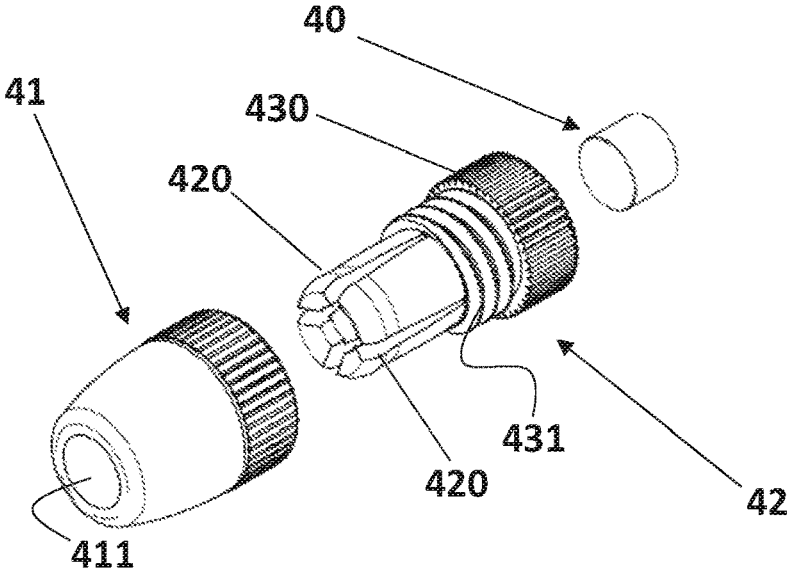
Figure 12:
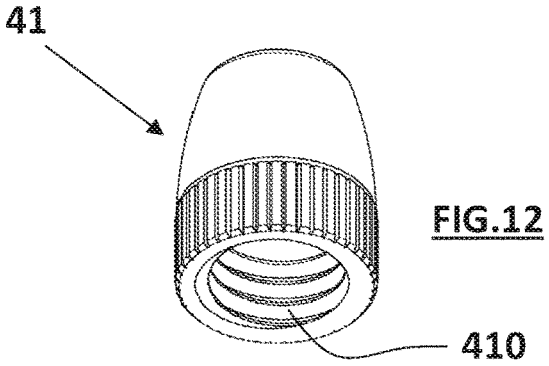
FIG. 12 shows a detail of the aforesaid end cap.

For example, each magnet (40) can be associated with the string (4) by means of a two-parts support (41, 42), in which a first part element (41) is a bushing with a through-hole (411) with an internal thread (410) on its front edge, and a second part element (42) has a shank made up of flexible little wings (420) and a head (430) which houses the magnet (40) on the front side and which on the back side has a thread (431) complementary to that of the first part (41). Each end (4*h*) of the string is inserted through a corresponding bushing (41) until it reaches the corresponding stem (420) of the second element (42), after which it is screwed onto the bushing, locking the magnet (40) to the end (4*h*) of the string (4). In FIG. 10, FIG. 11 and FIG. 12 are illustrated the first and second said elements (41, 42) of the magnet support (40). FIG. 6 shows a phase of association of a magnet (40) to an end of the string (4). The external surfaces of said elements (41, 42) can be knurled or in any case machined, instead of being smooth, to facilitate their use.

It is understood that instead of two magnets of opposite pole, only one magnet (40) can be used at one end of the string and a button of metal material at the other end of the same string so as to allow the reciprocal coupling of the two ends of the string by magnetic effect. In practice, the details of execution can still vary in an equivalent manner with regard to the individual elements described and illustrated without leaving the scope of the idea of solution adopted and therefore remaining within the limits of the protection granted by this patent.

The invention claimed is:

1. Lace lock comprising a body with openings that can be crossed by a lace (4) and provided with means for locking the lace in a locking position in which the sliding of said lace through said openings is prevented, said means also being adapted to unlock the lace to allow it to slide in said openings, characterized in that said body is constituted by a frame (1) on which two opposed levers (2*d*, 2*s*) are hinged, with a right lever (2*d*) and a left lever (2*s*), each of which can rotate on said frame (1) to assume a raised position (A) and respectively a lowered position (B), in which in the raised position (A) each lever (2*d*, 2*s*) leaves a corresponding space (3*d*, 3*s*), crossable by a lace (4), space that is closed when the levers (2*d* , 2*s*) are in lowered position, so that, when the levers (2*d*, 2*s*) are raised, the lace (4) is free to slide between each of the levers (2*d*, 2*s*) and the frame (1) and vice versa, when the levers (2*d*, 2*s*) are lowered, the lace (4) is not free to slide, wherein each of said levers (2*d*, 2*s*) is structured so as to define an empty space (VS) within each said lever (2*d*, 2*s*), the empty space (VS) configured to be crossable by the lace (4).

2. Lace lock according to claim 1 characterized in that said levers (2*d*, 2*s*) have a free end (20*d*, 20*s*) projecting beyond a respective edge (12) of said frame.

3. Lace lock according to claim 1 characterized in that said levers (2*d*, 2*s*) have a concave free end (20*d*, 20*s*), with the concavity facing downwards.

4. Lace lock according to claim 1, characterized in that each of said levers (2*d*, 2*s*) has a central body (22*e*) and two arms (22*f*) which on one side are joined by said central body (22*e*) and, on the opposite side, are joined by said free end (20*d*, 20*s*).

5. Lace lock according to claim 4 characterized in that said arms (22*f*) are external to said frame (1) and said central body (22*e*) is inside the frame (1).

6. Lace lock according to claim 1 characterized in that each of said levers (2*d*, 2*s*) has a central body (22*e*) that is perforated and is inside the frame (1).

7. Lace lock according to claim 1 characterized in that said levers (2*d*, 2*s*) are hinged on the frame (1) by means of respective pins (22*d*) which are joined to each other by a connecting surface (2*x*) which is external to the frame (1).

8. Lace lock according to claim 1, characterized in that said levers (2*d*, 2*s*) have teeth (22*j*) resulting in front of teeth (1*j*) presented internally by the frame (1).

9. Lacing system for shoes characterized in that it comprises a lace lock (L) according to claim 1 and a shoe lace (4), the shoe lace (4) having ends, the shoe lace (4) provided, at the ends, with elements (40) that are mutually magnetically hookable.

10. Lacing system for shoes according to claim 9 characterized in that said elements are formed by two magnets (40) of opposite poles.

11. Lacing system for shoes according to claim 9 characterized in that said elements are removably applied to the ends of the lace (4).

12. Lacing system for shoes according to claim 9 characterized in that each of said magnetically hookable elements (40) surfaces is applied to the lace (4) by means of a support made of two mutually couplable parts (41, 42).

13. Lacing system for shoes according to claim 12 characterized in that said parts (41, 42) are screwed on each other and tighten the support on the lace (4).

14. Lace lock according to claim 1, wherein the space (VS) is configured to allow a positioning of the levers (2*d*, 2*s*) in the lowered position adhering to the frame (1).

15. Lace lock according to claim 1, wherein the levers (2*d*, 2*s*) are configured to be positioned in the lowered position so as to adhere to the frame (1).

* * * * *